US005513408A

United States Patent [19]

Minakami et al.

[11] Patent Number: 5,513,408

[45] Date of Patent: May 7, 1996

[54] FRAME STRUCTURED BRIDGE

[76] Inventors: Hiroyuki Minakami, 2-1-1 #109 Nishi Okamoto, Higashi Nada-Ku Kobe, Hyogo 658; Motoyuki Minakami, 1-6-16 Agnogi, Matue-shi Shimane-ken 690, both of Japan

[21] Appl. No.: 249,154

[22] Filed: May 25, 1994

[30] Foreign Application Priority Data

Jun. 2, 1993 [JP] Japan ..... 5-168296

[51] Int. Cl.[6] ..... E01D 11/00

[52] U.S. Cl. ..... 14/18

[58] Field of Search ..... 14/18–23, 75, 14/77.1, 77.3, 8, 9

[56] References Cited

U.S. PATENT DOCUMENTS

| | | | |
|---|---|---|---|
| 3,979,787 | 9/1976 | Ahlgren | 14/75 |
| 4,069,765 | 7/1978 | Muller | 104/123 |
| 4,208,969 | 6/1980 | Baltensperger et al. | 104/11 |
| 4,253,780 | 3/1981 | Lecomte et al. | 405/202 |
| 4,451,950 | 6/1984 | Richardson | 14/18 |
| 4,457,035 | 7/1984 | Habegger et al. | 14/18 |
| 4,513,465 | 4/1985 | Schambeck | 14/17 |
| 4,535,498 | 8/1985 | Webster | 14/18 |
| 4,589,156 | 5/1986 | Schambeck | 14/4 |

FOREIGN PATENT DOCUMENTS

| | | |
|---|---|---|
| 3-80203 | 12/1991 | Japan . |
| 4-26002 | 5/1992 | Japan . |

OTHER PUBLICATIONS

A. S. Beard, "Development of the Tsing Ma Bridge," The Structural Engineer, vol. 71, No. 11, Jun. 1, 1993, pp. 192–195.

*Primary Examiner*—Michael Powell Buiz
*Attorney, Agent, or Firm*—Limbach & Limbach

[57] ABSTRACT

A suspension bridge structure is disclosed which uses horizontal cables, tensioned between anchorages, and frame lateral girder/node members connected between the horizontal cables to form frames. A tower section protrudes between the horizontal cables and is attached to the horizontal cables. A main cable is extended between the anchorages and over the top of the tower section. The frame lateral girder/node members are suspended from the main cable. A roadway or other transportation system can be supported on the frame lateral girder/node members.

27 Claims, 7 Drawing Sheets

FRAME STRUCTURED BRIDGE

BACKGROUND OF THE INVENTION

1. Field of the Invention

The present invention is related generally to bridges, and in particular to a bridge structure which employs frame structures.

2. Description of the Prior Art

Steel, because of its structural strength, has been used for making bridges. Engineers and designers have been trying to elongate the main span between the main towers because there is a demand for such bridges to span wider obstructs such as straits, wide rivers and bays.

Due to present technology and innovation, only suspension bridges and cable stayed bridges are usually used for long spans. The present type of suspension or cable-stayed bridge is designed with a hanging bridge girder. The deck or box shaped girder of present bridge design is installed without input of any stresses except naturally occurring longitudinal direction tension by its dead load. Especially for long bridges, there is a need to consider that the transverse force, which is generated mainly from winds, is the main force acting against the bridge. Also, there are limitations to the hanging method of constructing the girder for suspension or cable-stayed bridges. Therefore, the deck or box shaped girder has potential strength that is under-utilized because the deck or girder box is not stressed or tensioned prior to the installation.

Regarding the concept of these two bridge designs, for example, suspension bridges, the deck or box shaped girder is simply hung from the main cable. This deck or box shaped girder is the only structure against transverse direction force such as strong winds. This does not protect against the transverse direction force. Of course, the cable contributes some degree of transverse direction. However, cables or girders are basically swayable, especially when transverse force is applied because those are just hung, also, in the case of super-long bridges, after construction of the deck or box shaped girder. It is covered and the road is installed. This is how the load weight, which is mainly from vehicles, is sustained.

In the case of cable-stayed type bridge, the skew cable suspended From the main tower has the role of sustaining the deck or box shaped girder can withstand the horizontal force.

The present concept of design, as explained above, requires that the girder becomes large and heavy in order to resist strong horizontal direction forces, such as strong winds. This large and heavy structure requires stronger and heavier cables and limits the length of its span. This is why the present concept of bridge design has a corresponding problem: how can one build much longer bridges with present cable and steel technology without adding to the size and weight of present methodology.

The main reason is that the character of steel, which originally has very strong tensile strength, is not fully utilized. The present design method of long bridges, especially for suspension and cable-stayed bridges, is as follows:

1. The girder is designed based on the stability and strength against the winds.
2. The strength of the suspension main cable design is based on the girder weight which is noted above.
3. The length of the span is determined based on the limit of tension strength of main cable.

Based on our existing theory or concept of designing long bridges, it is anticipated that the present span length limitation of about 2~3 km can now be surpassed.

In addition to the current design problem there is another factor that must be considered.

Usually steel is weaker against compressing forces than against tensile forces. Therefore, the structural steel has to have wider cross section areas to be able to support buckling loads created by a heavier girder structure and protect against strong winds which exert horizontal force on the bridge.

It is clear that if the potential tensile strength of steel is utilized completely against horizontal forces, usually created by strong winds, the minimization of the weight of the girder is possible. When the weight of the girder is diminished, the burden to the main cable is decreased, consequently the central span length can be made much longer. Therefore, in order to design long or super long bridges, the minimization of the girder's weight, through the use of applying potential tensile forces, would be the most important objective.

In addition to the method of how to give the girder pre-tensile force, there is one more aspect which must be considered and that is how to construct those long bridges. According to present construction methods, after hanging each girder, the girders are connected to each other. Because of this, the girders are simply hung to the cable. There is no horizontal direction tension, except the tension of main cable, in the present bridge design system. In fact, as longer bridges are designed, engineers will find that the bridge's span can not be lengthened since the problem just described is not taken into consideration.

As long as the girders are set without horizontal direction tension, the potential strength of steel is not perfectly utilized. A problem occurs because the total strength of the bridge is insufficient. Current bridge design engineering is creating strength of the girder by simply increasing the size of the girder. Therefore, under the present method, to complete the construction of a bridge, more material and expense is required. Consequently the bridge becomes much heavier than an ideal structure which restricts the maximum length of the bridge's span.

Information about the state of the suspension and cable stayed bridge art is provided in the following: U.S. Pat. No. 4,589,156 to Schambeck; U.S. Pat. No. 4,513,465 to Schambeck; U.S. Pat. No. 4,535,498 to Webster; 4,457,035 to Habegger et al.; U.S. Pat. No. 4,451,950 to Richardson; U.S. Pat. No. 4,253,780 to Lecomte et al.; U.S. Pat. No. 4,208,969 to Baltensperger et al.; U.S. Pat. No. 4,069,765 to Muller; U.S. Pat. No. 3,979,787 to Ahlgren; Japanese Laid Open Applications 4-26002 and 3-80203; and Beard, A. S., "Development of the Tsing Ma Bridge," THE STRUCTURAL ENGINEER, Vol. 71, No. 11, June 1993, pages 192–195.

SUMMARY OF THE INVENTION

The object of this invention is to provide a new concept for designing long bridges. Also, this invention provide how to construct long or super long bridges. This design, by utilizing all of the potential strength, will prevent the problem forces, and will prevent the problems of a weak structure as earlier explained. This will enable longer span lengths to be obtained by using the same amount of material and expense. Also, this invention improves aerodynamical stability and seismic stability of the long span bridge, because the total amount of material can be diminished and as a result, the transverse force which the bridge receives is extensively decreased.

In this invention, pre-tensioned cables receive most of the horizontal force, which is created primarily by strong winds. Also, in order to produce maximum effectiveness, the frame structure is formed parallel to the bridge direction at the point of joint position of the main cable or cable-stayed. This pre-tensioned frame structure is a totally new idea for adding maximum strength to the bridge. The maximum strength of the steel structure is produced by installing pre-tensioned main cables, horizontal cables, upper stayed cables, hanger cables, crossing hangers and down stayed cables.

These pre-tensioned cables are set and fixed in an array at regular intervals along the bridge direction, in other words, the longitudinal direction. In order to install super-high pre-tension to the horizontal cable, it is anchored to the tower or to the base anchorage so the frame structure might be combined with the tower structure.

DETAILED DESCRIPTION

Figure 1:
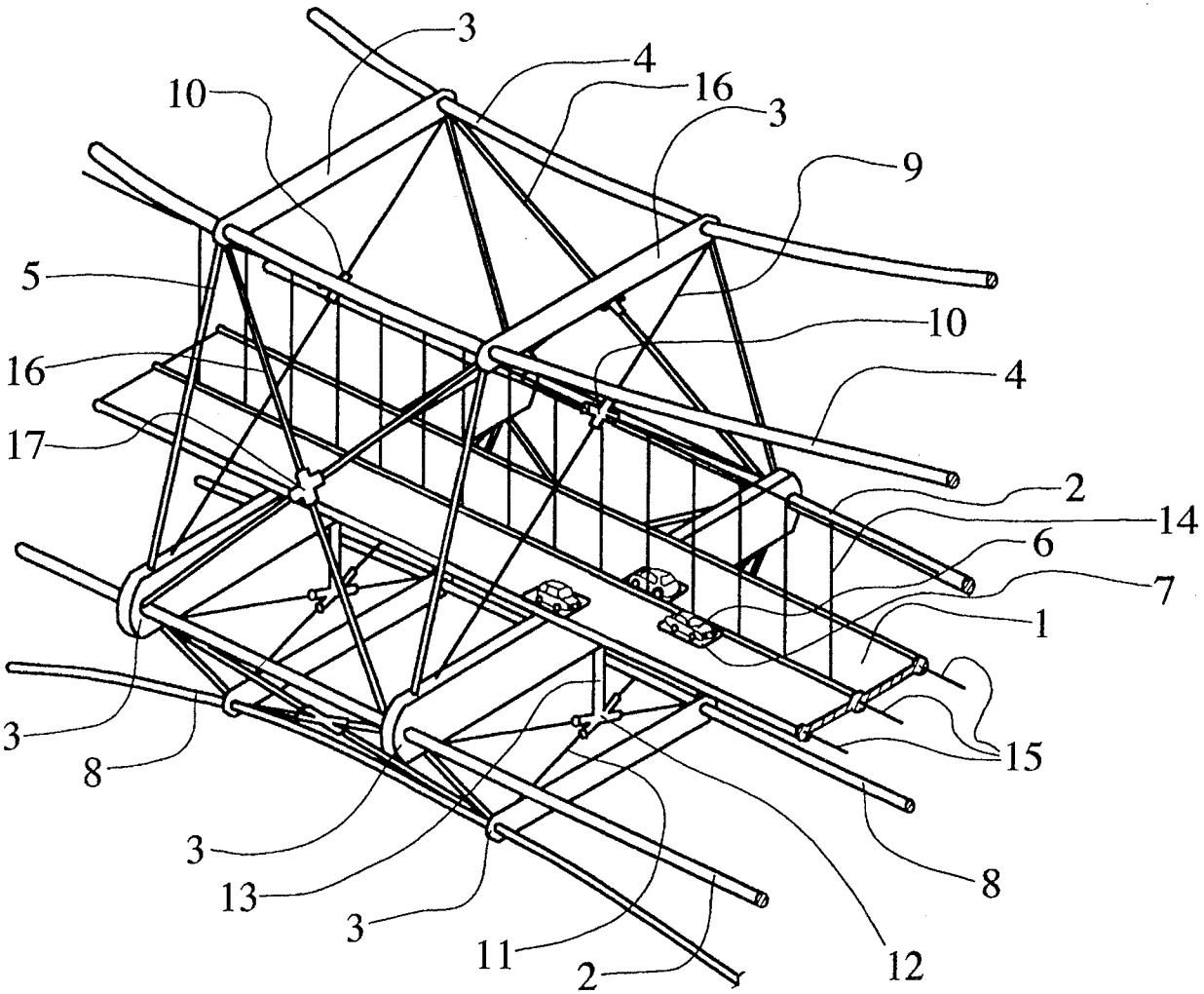
FIG. 1 illustrates a bird's-eye view of a section of the frame structured bridge of the present invention.

The parts or members which are to construct the bridge's structure are set, fixed and highly pre-tensioned. The frame structure is made of appropriate material and is structured to support the maximum force, depending upon the type of force needed to be supported.

If the force is horizontal, the material should have enough strength to resist the compressing force. Most of the compressing forces are put to the main tower and most of the horizontal forces are supported by the frame structure, which has a great deal of pre-tension force. On the other hand, if the force is vertical against the bridge direction, the material should have enough strength to resist the tensile force.

In case of a strong gust of wind hitting the bridge, these structures will share the force of the gust. In order to maintain the maximum strength of the characteristic frame structure, it is best if the width of the frame structure is wider than that of the road on the deck. This design enables the building of bridges which will have a much stronger structure against horizontal forces.

By adopting a wider span of the frame structure, geometrical moment of inertia, which is generally induced in proportion to the second power of the distance of the length, of the bridge becomes greater and high tension force is applied into the horizontal cables, main cables, upward stayed cables, downward stayed cables and the like. This causes the structure which forms the frame structure to become highly tensioned. Due to this intentional high tension, the frame structure is very stiff.

The frame lateral girder/node member is set up in the space above the main span. The frame structured lateral girder/node member is put in an orderly position toward the longitudinal direction. The road and transportation system is installed on the frame lateral girder/node member.

Therefore, even though this invention is for a type of suspension bridge or cable stayed bridge, the frame structured lateral girder/node member is somewhat similar to a steel truss bridge for the road and transportation system. Also, the lateral girder/node member structure is fixed and the road and transportation system is installed on the bridge floor.

In the case of designing bridges with long spans, the stiffness of the bridge is formed by the frame structure and each frame structured lateral girder/node member supports the bridge floor. Thus, the span can be extended by using these frame structured lateral girders/node members.

Under the present design method, after the main cable is installed, the already assembled girder is set by being hung directly to the main cable. According to this invention, all the members of the frame structure are installed to their set location. At the same time, or after placing the members, the horizontal cable is crossed over between anchorages and is connected with the members of the frame structured lateral girder/node member. The horizontal cable is highly tensioned by the anchor.

The result is a highly tensioned frame structure which will have a great deal of stiffness. The back frame structures are arranged across the full span of the bridge.

The horizontal cable is set in an arch in order to keep some degree of clearance from the sea level for the lateral girders/node members by the arch shape. When the horizontal cable is pulled horizontally with high tension, a downward direction force is generated and this force balances well with the upward force from the hanger and the main cable. This is the way to produce a high-tensioned bridge structure.

As explained above, the high tension is formed to the frame structure lateral girders/node members, then the road or transportation system is installed on the bridge floor. The cross-cable is for reinforcement of the frame structure.

In utilizing the invention for a stayed-cable bridge, first the frame structure lateral girder/node member is put at the center of the main span. Then, the horizontal cable is set through the frame structure and is settled with the upward stayed cable to form the total frame structure of the bridge. The horizontal cable is then crossed over between anchorages and/or towers. The tensile force is put to the horizontal cable from the anchor and is strongly tensioned.

DESCRIPTION OF THE PREFERRED EMBODIMENTS

Referring now in detail, to the drawings. FIG. 1 illustrates a section of the frame structured suspension bridge with a bird-eye view. The automobile 6 runs on the road 7 which is installed on the lateral girder/node member. The main cables 4 are hung parallel over the towers, the frame structured lateral girder/node member 3 is installed and attached to the cables 4. In this figure, there are three segments, the first is the upper section which is connected to each main cable 4, the second is the middle section which is connected to each horizontal cable 2, the third is the lower section which is connected to each arch cable 8.

Figure 2:
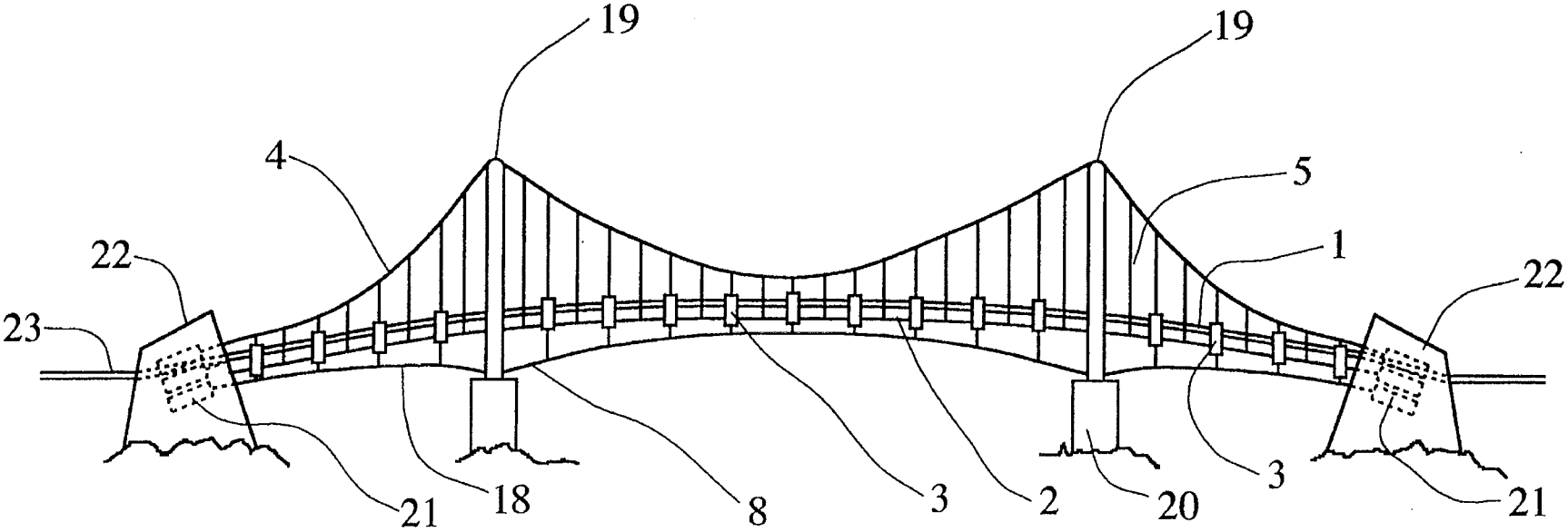
FIG. 2 illustrates another embodiment of the frame structured bridge of the present invention.

The main cable 4, horizontal cable 2 and arch cable 8 are tensioned by anchor of anchorage. These cables are pulled toward each other through the frame structured lateral girder/node member 3, hanger 5 and hanger for the arch cable 18 (FIG. 2). The lateral girder/node member 3 has the function of sustaining the shape of these cables. In the structure of the lateral girder/node member, there are two kinds of places where one is given a compressing force and the other is tensile force. Each frame structured lateral girder/node member 3 becomes a joint node against the longitudinal direction. By changing the span of the lateral girder/node members 3, we can most appropriately control the tension force. For example, when the lateral girder/node member which is in place near by main tower, is larger than the lateral girder/node member which is far from the tower, horizontal cable outlines arch like shape, from the upper view, therefore, we can effectively create maximum tension to the bridge structure. Thereafter, the lateral girder/node member 3 is installed in the bridge structure by the cable which has applied the maximum tensile force.

The cables which are mentioned above, main cable 4, horizontal cable 2, arch able 8, hanger cable 5 and hanger for arch cable 18 (FIG. 2), are usually made from steel, however, carbon fiber or newly developed materials can be used as long as the material has enough strength to resist the tensile force.

The reinforcing cable 16 is positioned in between the lateral girder/node members 3 to bolster the lateral girder/node members, especially against the compressing force. The connecting joint 17 for the reinforcing cable 16 links the lateral girder/node member and the cable and also forms the truss structure. The upper cross hanger 9 connects the upper lateral girder/node member 3 and the down lateral girder/node member 3 and is linked by the upper cross hanger 10. With all the linked cross hangers, the total structure becomes resistant to the transverse forces.

The upper cross hangers are connected to each other. Connected hangers are utilized to apply the point for center hanger 14 to hang the bridge floor 1.

According to the invention, a large size of the frame structured lateral girder/node member is installed and extended through the bridge structure, the bridge floor 1 and road 23 are then put onto the structure. The structure receives most of the outer forces, such as winds or earthquakes, thus the bridge will not sway much. Also, the frame structure itself is stiffened and tensioned from several directions by reinforcing cable 16, connecting joint 17 for the reinforcing cable 16, cross hanger 9, upper cross hanger 9, connecting joint 10 for the cross hanger 9, lower cross hanger 11 and connecting joint 12 for lower hanger. Particularly connecting joints 17, 10 and 12 have characteristic functions of preventing deformation of the frame structure, as a result the strength of the structure increases.

The bridge floor 1 is hung between the frame structure 3 by the center cable 14. Meanwhile, as the floor is tensioned by the stiffening cable 15, the cable connects the frame structured lateral girder/node members, similar to how a precast concrete bridge has tensioned strength. If the new transportation system is applied to this invention for a bridge design, it will be the best combination for constructing longer bridges.

By means of FIG. 2, another embodiment of the suspension bridge, according to the invention, is herewith described.

The tower 19 is constructed upon the bridge pier 20. The main cable 4 is suspended. The horizontal cable 2 is fixed to the anchorage 22 by the anchor 21, then pulled to give tension to the cable 2. The bridge floor 1 is installed and supported by the frame structured lateral girder/node members 3. The lateral girder/node member 3 is arranged toward longitudinal direction with a forming joint. Arch cable 8 is given tensile force and this force generates a highly tensioned structure. Hanger 5 and hanger 18 are for the arch cable connection. The horizontal cable and arch cable form frame structure with the lateral girder/node member 3 which is in a longitudinal direction.

Figure 3:
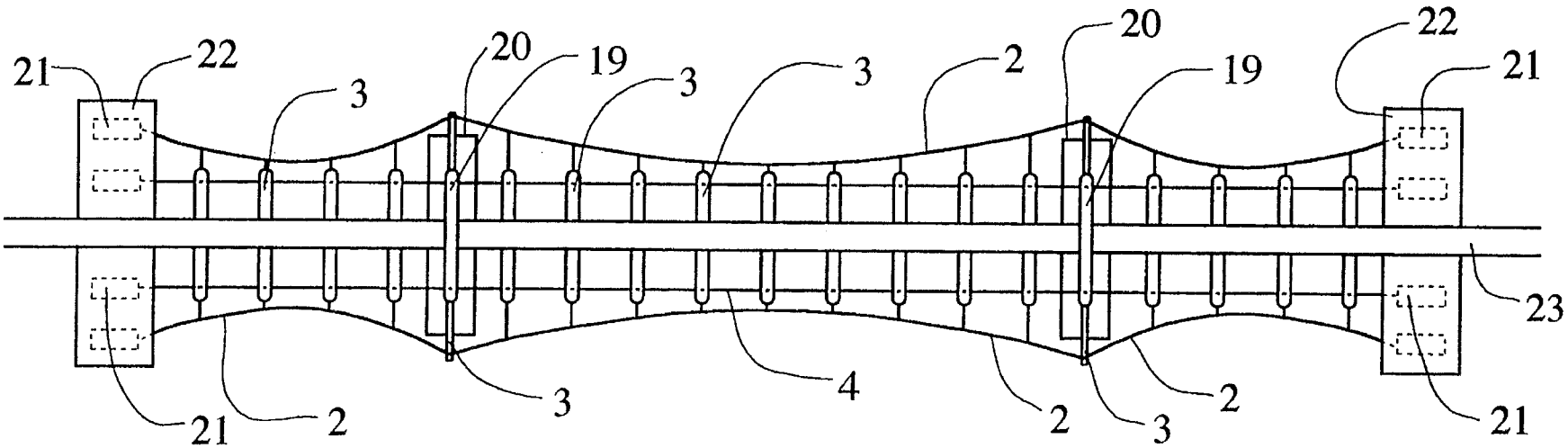
FIG. 3 is a view of the structure of FIG. 2 from above.

FIG. 3, is FIG. 2 viewed from above. The position of horizontal cable 2, main cable 4 and arch cable 8 may take the same position, however it is usually better to take a different position to obtain stronger tension. By means of FIG. 3 the horizontal cable 2 is set in a position different from the main cable 4 and anchor cable 21. The lateral girder/node member 3 at the tower 19 and the anchor 21 not only fulfill their primary functions, but also give tension to the horizontal cable 2 through strategic positioning of the ends of this cable 2 to the lateral girder/node member 3 located at the tower 19 and the anchor 21. According to FIG. 3 the lateral girder/node member 3 should be connected to the horizontal cable 2, except at the tower and the anchor. It is through these connections and bindings that high tensile strength is generated to the horizontal cable 2, as well as to the bridge itself, resulting in the bridge obtaining its high stiffness.

Figure 4:
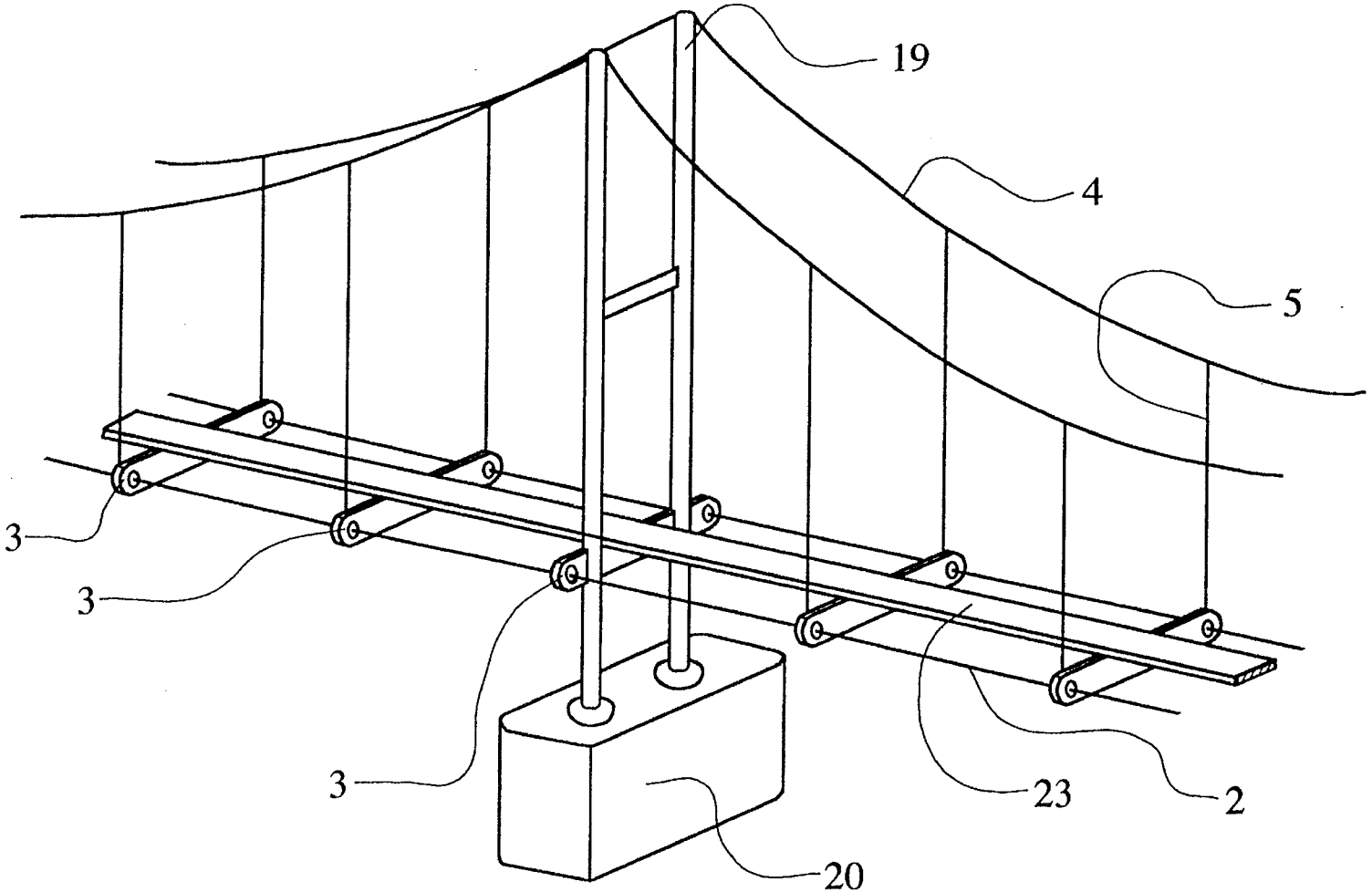
FIG. 4 illustrates the suspension bridge embodiment of the present invention without an arch cable.

FIG. 4 shows the case of suspension bridge which is lacking arch cable 8. The figure is a bird's-eye view around the tower 19. The frame lateral girder/node member 3 is hung by the main cable 4 and hanger 5. Meanwhile, the lateral girder/node member 3 is fixed in between the span by the horizontal cable 2. The new transportation system is then installed onto the lateral girder/node member 3. The tower 19 is combined with the lateral girder/node member 3. The distance between horizontal cables 2 is wider than that of the tower. Due to the increased width, it is possible to obtain larger geometrical moment of inertia and tensile force. Consequently, the stiffness of the frame of the bridge becomes stronger.

Figure 5:
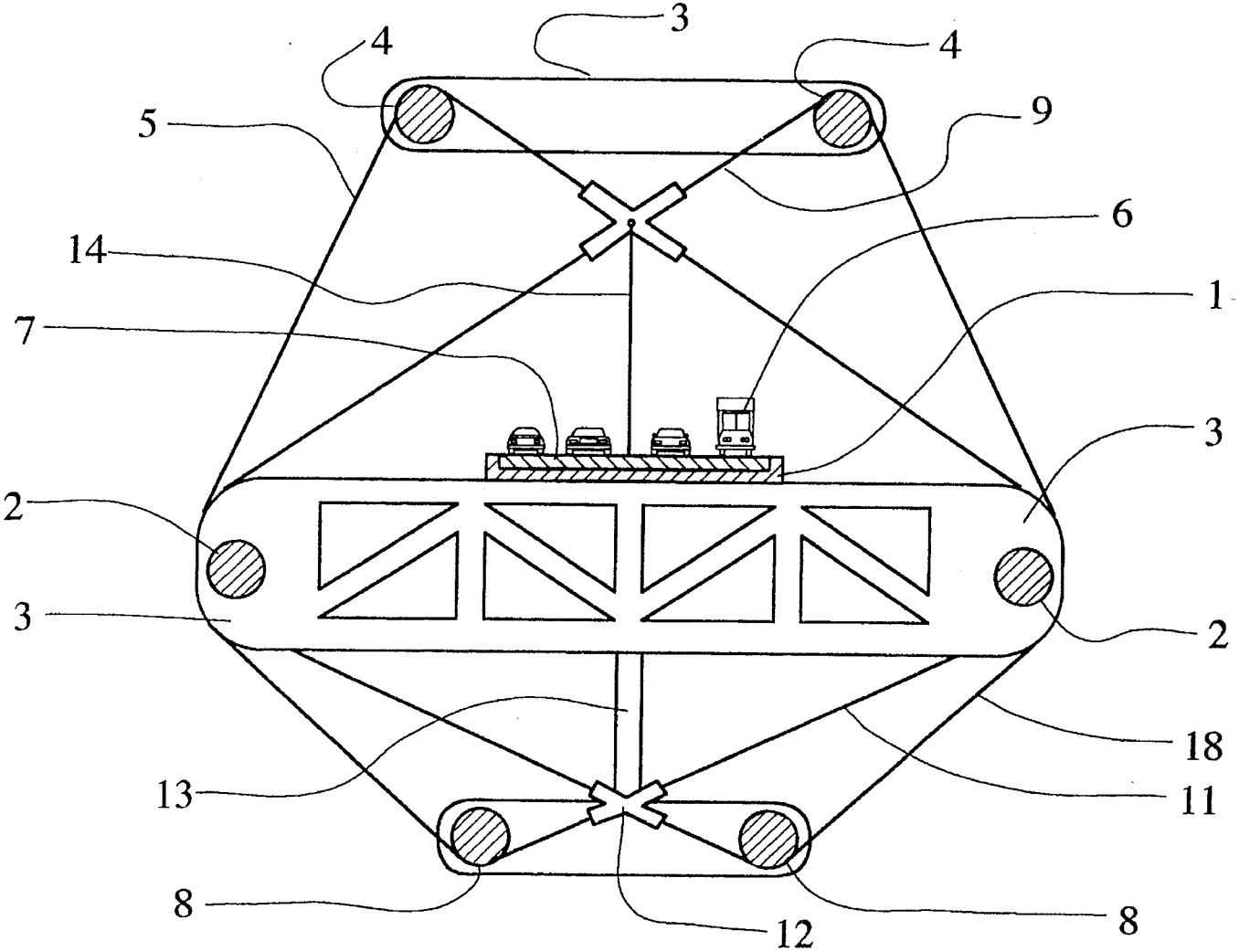
FIG. 5 shows a cross section of the central span area of the suspension bridge embodiment of the present invention.

FIG. 5 shows a cross section of central span area of the suspension bridge. The frame lateral girder/node member 3, which connects the main cables 4 and the horizontal cables 2, and the other lateral girder/node member which connects right and left arch cables 8, are installed. When a load is put on the lateral girder/node member 3, the lateral girder/node member will maintain its position because the main cable 4, frame lateral girder/node member 3, and upper hanger 9 are connected. Likewise, arch cable 8 and frame lateral girder/node member 3 are connected and the lower hanger 11 and lower cross hanger joint 12 are connected for added stiffness. Central support 13 sustains the bridge floor 1 from below. Additionally, the support is connected with the lower cross hanger 12. This example identifies the road for automobiles as a bridge floor, however, the bridge floor can be railroad or any type of transportation system. By means of FIG. 5, the road for automobiles is shown. In this case, automobiles 6 are running on the road 7. The bridge floor 1 is hung by the central hanger 14 which is connected with an upper cross hanger connector 10.

Figure 6:
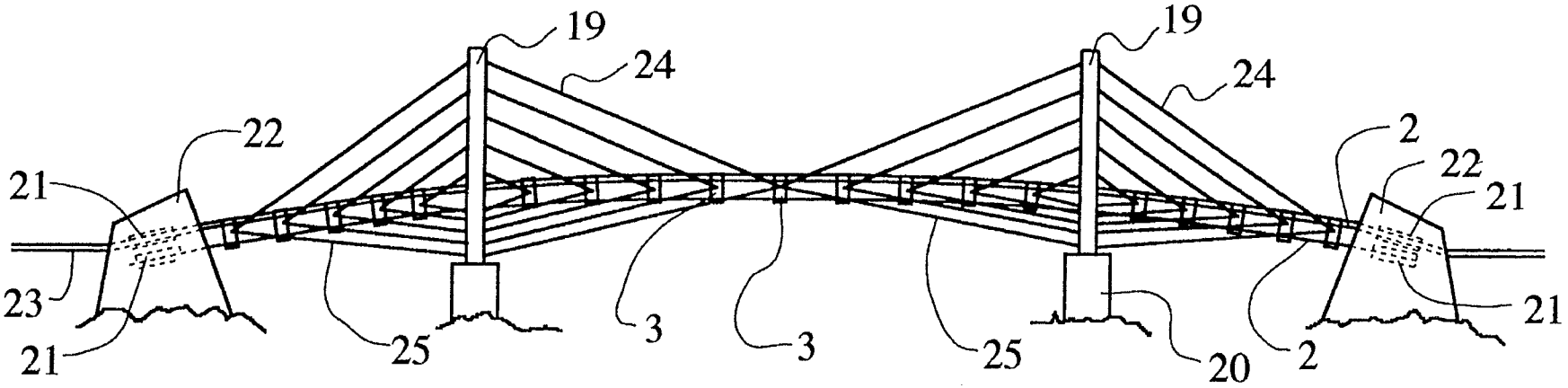
FIG. 6 illustrates a cable-stayed embodiment of the present invention.

FIG. 6 shows the case of cable-stayed bridge. The tower 19 is constructed upon the bridge pier 20. Horizontal cable 2 is fixed at the place of anchorage 22 by the anchor 21 to obtain tensile force. The frame lateral girder/node member 3 is pulled by the upper stayed cable 24 and the lower stayed cable 25 toward the tower 19, however the lateral girder/node member 3 is also pulled by horizontal cable 2 to be balanced. The bridge floor 1 is constructed onto the frame lateral girder/node member 3. The frame lateral girders/node member 3 are arranged in a longitudinal direction forming a bone-like frame. The frame of the bridge structure will then obtain a highly pre-tensioned force through the horizontal cable 2, upper stayed cable 24 which is hung from the tower 19 and the lower stayed cable 25. The road for automobiles is installed on the frame lateral girders/node member 3 which are arranged in a longitudinal direction with the bridge floor. In the case of FIG. 6, the position of the starting point of upper stayed cable 24 and lower stayed cable 25 from the tower 19 is inside the width of the tower 19, however, it is not necessary that the starting point should be within the width of the tower.

Figure 7:
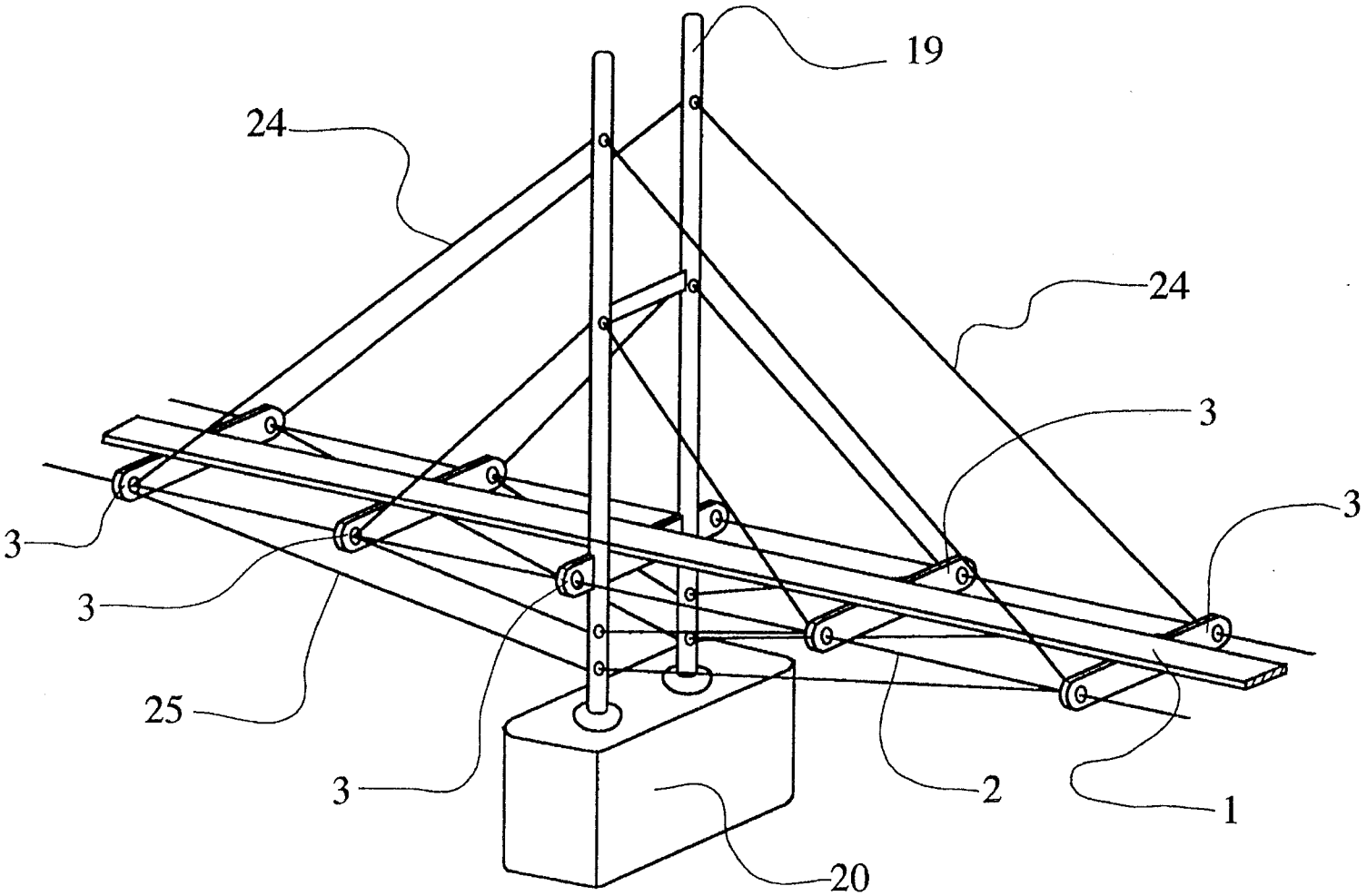
FIG. 7 is a bird's-eye view in the vicinity of the tower portion of the cable-stayed embodiment of FIG. 6.

FIG. 7 is a bird's-eye view around the tower 19 of a cable-stayed bridge. The frame lateral girders/node members 3 are installed by the upper stayed cable 24 and the lower stayed cable 25 and the horizontal cable 2. Upon the lateral girder/node member 3, the bridge floor 1 is installed. At the tower 19, the lateral girder/node member 3 and the tower 19 are actually one unit (i.e. the tower 19 has a built in lateral girder/node member 3). The width of both sides of the horizontal cable 2 is wider than that of the tower 19. The increased width will create a larger geometrical moment of inertia and tensile force. The strength of bridge structure then becomes much stronger than conventional cable-stayed bridge.

Therefore, many modifications and embodiments of this specific invention will come to mind to one skilled in the art by having the teachings presented in the foregoing description and accompanying drawings of this invention and hence it is to be understood that the invention is not therefore limited and that such modifications, etc., are intended to be included in the scope of the appended claims.

What is claimed is:

1. A suspension bridge structure positioned between anchorages, especially of the type which has a bridge floor for a transportation system and a bridge pier positioned under the bridge floor, comprising horizontally oriented cables which extend between the anchorages;

a tower section positioned on said bridge pier and which protrudes between the horizontal cables;

a first plurality of frame lateral girder/node members which are spaced apart in a longitudinal direction along, and positioned between and in a connecting relationship with said horizontal cables, to form frames in combination with the horizontal cables;

a first main cable connected at each end to said anchorages and extending over the top of said tower; and frame hangers which suspend said frame lateral girder/node members from said first main cable;

wherein said bridge floor for a transportation system is supported by said frame lateral girder/node members.

2. The suspension bridge of claim 1, wherein the frame hangers also suspend said frame lateral girder/node members from said second main cable, further including a second main cable connected at each end to said anchorages and extending over the top of said tower; and pairs of upper cross hangers each pair of which connects said first and second main cables to one of said frame lateral girder/node members, wherein in each pair of upper cross hangers one upper cross hanger extends from a point on the first or second main cables which is generally above one end of a frame lateral girder/node member to an other end of the frame lateral girder/node member, and the other upper cross hanger extends from a point on the first or second main cables which is generally above the other end of the frame lateral girder/node member to the one end of the frame lateral girder/node member, so that an associated pair of upper cross hangers cross each other above each frame lateral girder/node member.

3. The suspension bridge of claim 2, wherein one of the horizontally oriented cables is positioned generally beneath the first main cable, and an other of the horizontally oriented cables is positioned generally beneath the second main cable, and further wherein additional pairs of upper cross hangers are arranged so that in each of the other pairs of the upper cross hangers one of the upper cross hangers extends from a point on the first main cable to a point on the other of the horizontally oriented cables, and the other upper cross hanger extends from a point on the second main cable to a point on the one of the horizontally oriented cables, so that the upper cross hangers in each of the other pairs of upper cross hangers cross each other.

4. The suspension bridge of claim 3, further wherein additional ones of the center hangers are connected between an associated upper connecting joint and the bridge floor.

5. The suspension bridge of claim 2, further including upper connecting joints each of which joins the upper cross hangers in each pair of upper cross hangers to one another where they cross.

6. The suspension bridge of claim 5, further including center hangers each connected between an associated upper connecting joint and an associated frame lateral girder/node member.

7. The suspension bridge of claim 6, further including pairs of reinforcing cables each pair connecting an associated pair of the frame lateral girder/node members to the first or second main cables, wherein in each pair of reinforcing cables one reinforcing cable extends from a point on the first or second main cables above a first end of one of the frame lateral girder/node members in the associated pair, to a first end of the other of the frame lateral girder/node members in the associated pair, and the other reinforcing cable extends from a point on the first or second main cables above the first end of the other frame lateral girder/node member in the associated pair, to the first end of the one frame lateral girder/node member in the associated pair, so that the reinforcing cables in the pair cross one another.

8. The suspension bridge of claim 7, further including additional pairs of reinforcing cables, wherein in each of the additional pairs of reinforcing cables one of the reinforcing cables extends from a point on the first or second main cables above the other end of the one frame lateral girder/node member in the associated pair to the other end of the other frame lateral girder/node members in the associated pair, and the other reinforcing cable extends from a point on the first or second main cables above the other end of the other frame lateral girder/node members in the pair, to the other end of the one frame lateral girder/node member in the associated pair, so that the reinforcing cables pair cross one another.

9. The suspension bridge of claim 8 further including side connecting joints each of which joins the reinforcing hangers in each pair of reinforcing hangers to one another where they cross one another.

10. The suspension bridge of claim 1, further including a first arch cable which extends generally horizontally between said anchorages and said bridge pier, and is located below said horizontal cables; and arch cable hangers which connect between said first arch cable and said frame lateral girder/node members.

11. The suspension bridge of claim 10 further including a second arch cable which extends generally horizontally between said anchorages and said bridge tower, and is located below said horizontal cables;

a second plurality of frame lateral girder/node members which are spaced apart in a longitudinal direction along, and positioned between and in a connecting relationship with said arch cables, to form frames in combination with the arch cables.

12. The suspension bridge of claim 11, further including pairs of lower cross hangers each of which connects an associated frame lateral girder/node member positioned on the arch cables to an associated frame lateral girder/node member positioned on the horizontal cables;

wherein in each pair of lower cross hangers one lower cross hanger extends from one end of the associated frame lateral girder/node member on the horizontal cables to an other end of the associated frame lateral girder/node member on the arch cables, and the other lower cross hanger extends from an other end of the frame lateral girder/node member on the horizontal cables to the one end of the frame lateral girder/node member on the arch cables, so that the lower cross hangers in the pair cross each other.

13. The suspension bridge of claim 12, further including lower connecting joints each of which joins the lower cross hangers in each pair of lower cross hangers to one another where they cross.

14. The suspension bridge of claim 13, further including central supports each connected between a lower connecting joint and an associated frame lateral girder/node member positioned on the horizontal cables.

15. The suspension bridge of claim 14, further including pairs of reinforcing cables each pair connecting an associated pair of frame lateral girder/node members positioned on the horizontal cables to an associated pair of frame lateral girder/node members positioned on the arch cables, wherein one of the frame lateral girder/node members in the associated pair on the horizontal cables is positioned generally above one of the frame lateral girder/node members in the associated pair on the arch cables, and the other of the frame lateral girder/node members in the associated pair on the horizontal cables is positioned generally above the other of the frame lateral girder/node members in the associated pair on the arch cables, and further wherein in each pair of reinforcing cables one reinforcing cable extends from one end of the one frame lateral girder/node member in the associated pair on the horizontal cables to one end of the other of the frame lateral girder/node members in the associated pair on the arch cables, and the other reinforcing cable extends from one end of the other frame lateral girder/node member of the associated pair on the horizontal cables to one end of the one frame lateral girder/node member of the associated pair on the arch cables, so that the reinforcing cables in the pair cross one another.

16. The suspension bridge of claim 15, further including additional pairs of reinforcing cables each pair connecting the other ends of the frame lateral girder/node members in the associated pairs on the horizontal cables and the arch cables, wherein in each of the additional pairs of reinforcing cables one of the reinforcing cables extends from the other end of the one frame lateral girder/node member in the associated pair on the horizontal cables to other end of the other of the frame lateral girder/node members in the associated pair on the arch cables, and the other reinforcing cable extends from other end of the other frame lateral girder/node member of the associated pair on the horizontal cables to other end of the one frame lateral girder/node member of the associated pair on the arch cables, so that the reinforcing cables in the additional pairs of reinforcing cables cross one another.

17. The suspension bridge of claim 16 further including lower side connecting joints each of which joins the reinforcing hangers in each pair of reinforcing hangers to one another where they cross one another.

18. The suspension bridge of claim 1, further including a second main cable connected at each end to said anchorages and extending over the top of said tower; and a third plurality of frame lateral girder/node members which are spaced apart in a longitudinal direction along, and positioned between and in a connecting relationship with said first and second main cables, to form frames in combination with the main cables.

19. The suspension bridge of claim 18, further including pairs of upper cross hangers which connect an associated frame lateral girder/node member positioned on the first and second main cables to an associated frame lateral girder/node member positioned on the first and second main cables;

wherein one end of the associated frame lateral girder/node member on the first and second main cables is positioned generally above one end of the associated frame lateral girder/node member on the first and second main cables, and an other end of the associated frame lateral girder/node member on the first and second main cables is positioned generally above an other end of the associated frame lateral girder/node member on the first and second main cables; and further wherein in each pair of upper cross hangers one upper cross hanger extends from the one end of the associated frame lateral girder/node member on the first and second main cables to the other end of the associated frame lateral girder/node member on the horizontal cables, and the other upper cross hanger extends from the other end of the associated frame lateral girder/node member on the first and second main cables to the one end of the frame lateral girder/node member on the horizontal cables, so the upper cross hangers cross.

20. The suspension bridge of claim 19, further including upper connecting joints each of which joins the upper cross hangers in each pair of upper cross hangers to one another where they cross.

21. The suspension bridge of claim 20, further including center hangers each connected between an associated upper connecting joint and an associated frame lateral girder/node member.

22. The suspension bridge of claim 21, further wherein additional ones of the center hangers are connected between an associated upper connecting joint and the bridge floor.

23. The suspension bridge of claim 22, further including pairs of reinforcing cables each pair connecting an associated pair of the frame lateral girder/node members on the first and second main cables with an associated pair of the frame lateral girder/node members on the horizontal cables, wherein one of the frame lateral girder/node members in the associated pair on the first and second main cables is positioned generally above one of the frame lateral girder/node members in the associated pair on the horizontal cables, and the other of the frame lateral girder/node members in the associated pair on the first and second main cables is positioned generally above the other of the frame lateral girder/node members in the associated pair on the horizontal cables, and further wherein in each pair of reinforcing cables one reinforcing cable extends from a first end of the one frame lateral girder/node member in the pair on the first and second main cables to a first end of the other frame lateral girder/node member in the pair on the horizontal cables, and the other reinforcing cable extends from a first end of the other frame lateral girder/node member in the pair on the first or second main cables to a first end of the other of the frame lateral girder/node member in the pair on the horizontal cables, so that the reinforcing cables in the pair cross one another.

24. The suspension bridge of claim 23, further including additional pairs of reinforcing cables, wherein in each of the additional pairs of reinforcing cables one reinforcing cable extends from an other end of the one frame lateral girder/node member in the pair on the first and second main cables to an other end of the other frame lateral girder/node member in the pair on the horizontal cables, and the other reinforcing cable extends from an other end of the other frame lateral girder/node member on the first or second main cables to an other end of the other frame lateral girder/node member in the pair on the horizontal cables, so that the reinforcing cables in the pair cross one another.

25. The suspension bridge of claim 24 further including side connecting joints each of which joins the reinforcing hangers in each pair of reinforcing hangers to one another where they cross one another.

26. A method of constructing a suspension bridge positioned between anchorages, especially of the type which has a bridge floor for a transportation system and a bridge pier positioned under the bridge floor, comprising the following steps:

(a) installing a tower section on the bridge pier;

(b) installing horizontal cables between the anchorages and placing the horizontal cables under tension;

(c) installing main cables between the anchorages and over the tower section;

(d) raising frame lateral girder/node members into a position between the horizontal cables using said main cables and connecting the frame lateral girder/node members to the horizontal cables;

(e) pulling the main and horizontal cables to generate a desired amount of tension and to position the lateral girder/node members;

(f) installing said transportation system onto said lateral girder/node members.

27. The method of claim 26 further including the step of (g) connecting an arch cable between the anchorages and a lower portion of said tower and to said frame lateral girder/node members to apply a downward tension on said lateral girder/node members.

* * * * *